US010815089B2

(12) United States Patent
Wada

(10) Patent No.: US 10,815,089 B2
(45) Date of Patent: Oct. 27, 2020

(54) MEDIUM WINDING DEVICE AND PRINTING SYSTEM

(71) Applicant: Oki Data Corporation, Tokyo (JP)

(72) Inventor: Toshiyuki Wada, Tokyo (JP)

(73) Assignee: Oki Data Corporation, Tokyo (JP)

( * ) Notice: Subject to any disclaimer, the term of this patent is extended or adjusted under 35 U.S.C. 154(b) by 339 days.

(21) Appl. No.: 15/920,994

(22) Filed: Mar. 14, 2018

(65) Prior Publication Data

US 2018/0282096 A1 Oct. 4, 2018

(30) Foreign Application Priority Data

Mar. 31, 2017 (JP) ..... 2017-069727

(51) Int. Cl.

| | |
|---|---|
| ***B65H 18/26*** | (2006.01) |
| ***B65H 23/195*** | (2006.01) |
| ***B65H 23/06*** | (2006.01) |
| ***B41J 15/16*** | (2006.01) |
| ***B65H 23/04*** | (2006.01) |

(52) U.S. Cl.

CPC ..... *B65H 18/26* (2013.01); *B41J 15/16* (2013.01); *B65H 23/048* (2013.01); *B65H 23/063* (2013.01); *B65H 23/1955* (2013.01); *B65H 2403/732* (2013.01); *B65H 2515/815* (2013.01)

(58) Field of Classification Search

CPC .... B65H 18/26; B65H 23/048; B65H 23/063; B65H 23/1955; B65H 2515/815; B65H 2403/732; B65H 2220/01

See application file for complete search history.

(56) References Cited

U.S. PATENT DOCUMENTS

| | | | | |
|---|---|---|---|---|
| 3,441,825 | A * | 4/1969 | Dinger | B65H 23/198 388/809 |
| 8,152,089 | B2 * | 4/2012 | Shin | B65H 23/1955 242/412.2 |
| 2011/0006148 | A1 * | 1/2011 | Tolrud | B65H 18/12 242/413.1 |
| 2013/0119182 | A1 * | 5/2013 | Higeta | B65H 18/145 242/538.1 |
| 2013/0126659 | A1 * | 5/2013 | Nakada | B65H 23/182 242/420.4 |
| 2016/0311638 | A1 * | 10/2016 | Minato | B65H 26/04 |
| 2017/0217623 | A1 * | 8/2017 | Kanno | B65H 26/025 |
| 2017/0275119 | A1 * | 9/2017 | Hamano | B41J 11/0095 |
| 2018/0017901 | A1 * | 1/2018 | Kanzawa | B60C 7/18 |

FOREIGN PATENT DOCUMENTS

JP 2013-216469 A 10/2013

* cited by examiner

*Primary Examiner* — William A. Rivera

(74) *Attorney, Agent, or Firm* — Muncy, Geissler, Olds & Lowe, P.C.

(57) ABSTRACT

The medium winding device includes a winding shaft, a drive unit for winding the medium around the winding member, a rotating member rotatably disposed, a tension applying member which moves as the drive unit is driven or stopped, a position detecting unit for detecting the position of the tension applying member, an output changing unit, a control unit that determines whether slippage occurs between the winding shaft and the winding member based on the position of the tension applying member and the result of output change by a rotation of the winding shaft. Further, the drive unit includes a torque limiter.

16 Claims, 11 Drawing Sheets

MEDIUM WINDING DEVICE AND PRINTING SYSTEM

TECHNICAL FIELD

The field of the disclosed subject may relate to medium winding device and printing system.

BACKGROUND ART

Printers for printing on continuous paper are known (see, for example, Japanese Patent Application Publication No. 2013-216469). A conventional printer receives continuous paper fed from a paper feeding device, prints on the continuous paper by a printing unit, and then discharges the continuous paper through an outlet to the outside of the printer.

A roll paper winding device is placed adjacent to the printer. The roll paper winding device winds the continuous paper discharged from the printer around a winding core in a winding mechanism and forms a paper roll as a roll medium.

In the conventional roll paper winding device, slippage occurs between the winding shaft of the winding mechanism and the winding core, and winding failure of the continuous paper may occur. However, in the conventional roll paper winding device, it cannot be predicted that winding failure occurs.

SUMMARY

One or more disclosed aspects provide a medium winding device capable of predicting occurrence of winding failure of continuous paper.

An example medium winding device includes (1) a winding member which winds the medium in a roll is detachably disposed with respect to a winding shaft; (2) a drive unit that gives a rotation drive to the winding shaft, includes a winding motor and a drive transmission unit; (3) a tension applying member that is disposed so as to be movable along a guide on the upstream side of the winding member in a conveyance direction of the medium, moves along the guide while being in contact with the medium to be conveyed, provides tension to the medium to be conveyed; (4) a rotating member that is disposed between the winding member and the tension applying member in the conveyance direction of the medium, guides the medium in the conveyance direction of the medium; (5) a position detecting unit that detects a position of the tension applying member; (6) an output changing unit with an output that varies according to a rotation of the winding shaft; and (7) a control unit that determines whether slippage occurs between the winding shaft and the winding member based on the position of the tension applying member and a result of output change by the rotation of the winding shaft. The drive unit includes a torque limiter that idles when torque equal to or greater than a limit torque is applied.

Another example medium winding device includes (1) a winding member which winds the medium in a roll is detachably disposed with respect to a winding shaft; (2) a drive unit that gives a rotation drive to the winding shaft, includes a winding motor and a drive transmission unit; (3) a tension applying member that is disposed so as to be movable along a guide on the upstream side of the winding member in a conveyance direction of the medium, moves along the guide while being in contact with the medium to be conveyed, provides tension to the medium to be conveyed; (4) a rotating member that is disposed between the winding member and the tension applying member in the conveyance direction of the medium, guides the medium in the conveyance direction of the medium; (5) a position detecting unit that detects a position of the tension applying member; (6) an output changing unit with an output that varies according to a rotation of the winding shaft; and (7) a control unit that eliminates looseness occurring in the roll medium formed by winding the medium on the winding member based on the position of the tension applying member and a result of output change by the rotation of the winding shaft. The drive unit includes a torque limiter that idles when torque equal to or greater than a limit torque is applied.

An example printing system comprises a printing apparatus and a medium winding device for winding up a medium discharged from a discharge port of the printing apparatus, the medium winding device includes (1) a winding member which winds the medium in a roll is detachably disposed with respect to a winding shaft; (2) a drive unit that gives a rotation drive to the winding shaft, includes a winding motor and a drive transmission unit; (3) a tension applying member that is disposed so as to be movable along a guide on the upstream side of the winding member in a conveyance direction of the medium, moves along the guide while being in contact with the medium to be conveyed, provides tension to the medium to be conveyed; (4) a rotating member that is disposed between the winding member and the tension applying member in the conveyance direction of the medium, guides the medium in the conveyance direction of the medium; (5) a position detecting unit that detects a position of the tension applying member; (6) an output changing unit with an output that varies according to a rotation of the winding shaft; and (7) a control unit that determines whether slippage occurs between the winding shaft and the winding member based on the position of the tension applying member and a result of output change by the rotation of the winding shaft. The drive unit includes a torque limiter that idles when torque equal to or greater than a limit torque is applied.

BRIEF DESCRIPTION OF THE DRAWINGS

The accompanying drawings are presented to aid in the description of examples of one or more aspects of the disclosed subject matter and are provided solely for illustration of the examples and not limitation thereof.

DESCRIPTION OF THE EMBODIMENTS

(1) First Embodiment

Hereinafter, embodiments will be described in detail with reference to the drawings. In this case, it will be described about a roll paper winding device as a medium winding device that is placed adjacent to the printer as an image forming apparatus.

Figure 2:
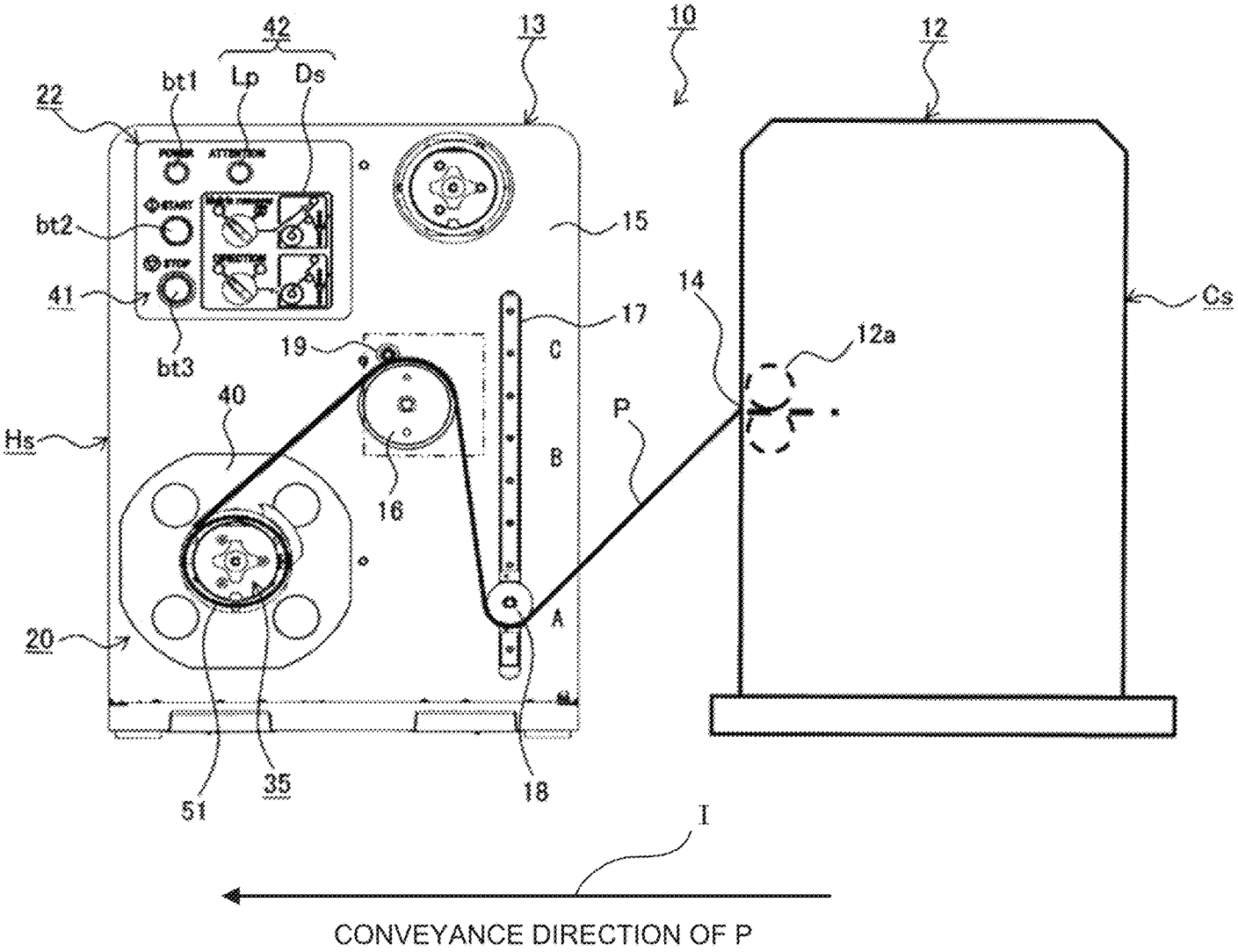
FIG. 2 is a diagram illustrating a printing system according to the first embodiment.
Figure 3:
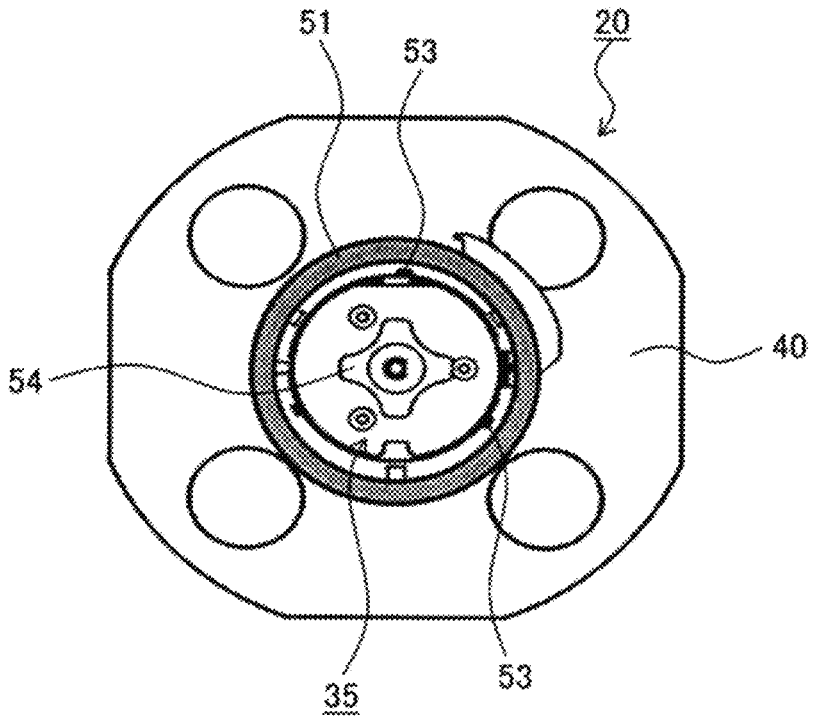
FIG. 3 is a front view illustrating the main part of the winding mechanism in the first embodiment.
Figure 4:
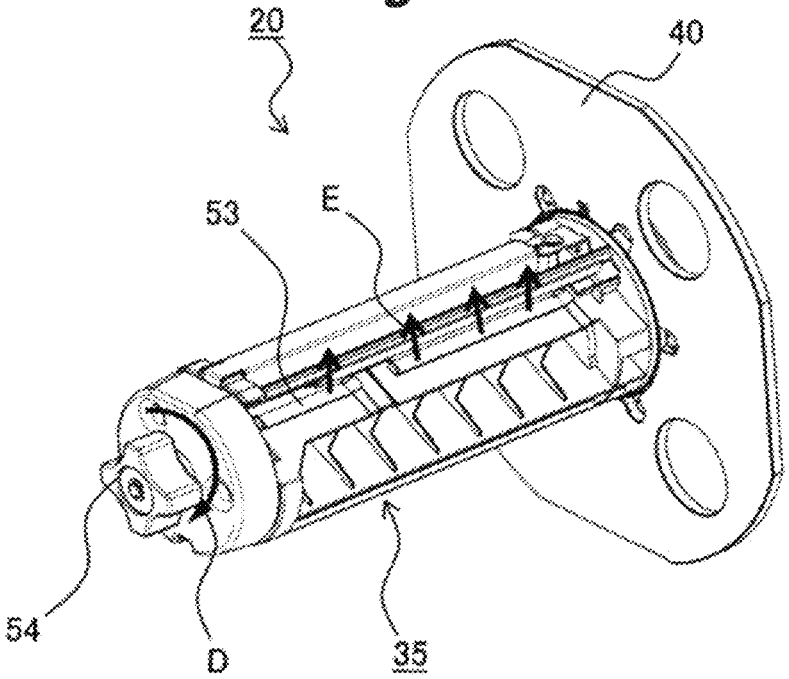
FIG. 4 is a perspective view illustrating the main part of the winding mechanism in the first embodiment.
Figure 5:
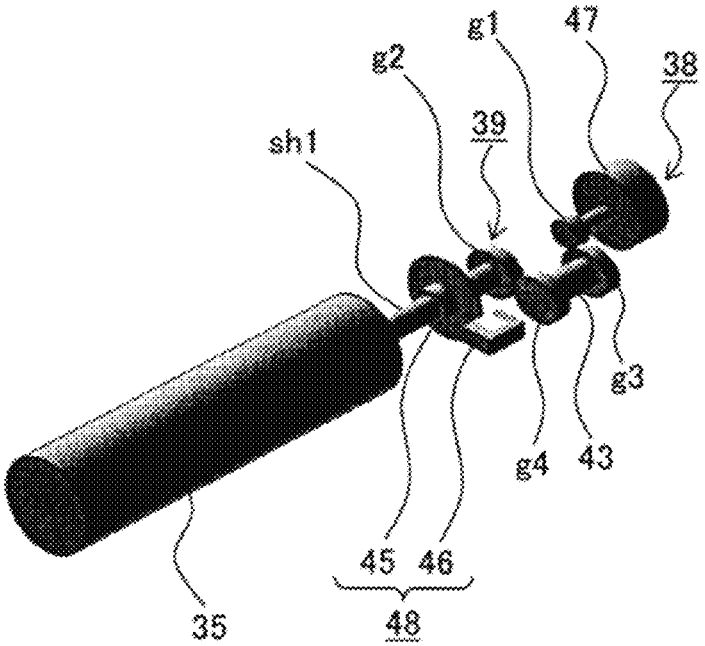
FIG. 5 is a perspective view illustrating a rotation transmission system of the winding mechanism in the first embodiment.

FIG. 2 is a diagram illustrating a printing system according to a first embodiment. FIG. 3 is a front view illustrating the main part of the winding mechanism in the first embodiment. FIG. 4 is a perspective view illustrating the main part of the winding mechanism in the first embodiment. FIG. 5 is a perspective view illustrating a rotation transmission system of the winding mechanism in the first embodiment.

In FIG. 2, the printing system 10 includes a printer 12 that performs printing on the continuous paper P, and a roll paper winding device 13 that takes in the continuous paper P discharged from the printer 12 and winds it in a roll form. The roll paper winding device 13 is disposed adjacent to the printer 12.

The printer 12 includes a paper feeding device (not shown), a printing unit (not shown), a pair of discharge rollers 12*a*, and a discharge port 14 (discharge unit) in the main body Cs. The continuous paper P fed from the paper feeding device is sent to the printing unit, after printing is performed in the printing unit, it is discharged from the discharge port 14 to the outside of the printer 12 by the pair of discharge rollers 12*a* (as shown the direction of the arrow I).

Further, the roll paper winding device 13 has a housing Hs, a slit 17, a tension roller 18, an idle roller 16, a roller 19, a winding mechanism 20, an operation/display unit 22, or the like. The slit 17 is a predetermined guide formed on a front panel 15. The slit 17 is the predetermined guide for the tension roller 18 in order to move the tension roller 18 in the vertical direction. The tension roller 18 is disposed so as to freely move in the vertical direction and rotate freely along the slit 17. Further, the tension roller 18 is a tension applying member that applies tension to the continuous paper P taken in by the roll paper winding device 13. The tension roller 18 applies tension to the continuous paper P by its own weight in a state of being in contact with the continuous paper P. The tension roller 18 moves in the vertical direction along the slit 17 while coming into contact with the medium to be conveyed. The idle roller 16 is a rotating member that protrudes from the front panel 15 and is rotatably disposed and rotates in accordance with the conveyance of the continuous paper P. The roller 19 faces the idle roller 16 and protrudes from the front panel 15 and is rotatably disposed. The winding mechanism 20 protrudes from the front panel 15 and is rotatably disposed to wind up the continuous paper P. The operation/display unit 22 is attached to the front panel 15.

The roll paper winding device 13 includes a winding motor 38 as a winding rotation generating unit and a rotation transmission system 39 for transmitting the rotation generated by driving the winding motor 38 to the winding mechanism 20. The roll paper winding device 13 also has a drive unit for conveying the continuous paper P and winding up the continuous paper P by the winding motor 38 and the rotation transmission system 39. The drive unit gives a rotation drive to a winding shaft 35. Since the rotation transmission system 39 transmits the rotation drive, the rotation transmission system 39 is also referred to as a drive transmission unit. The drive unit includes the winding motor 38 and the rotation transmission system 39.

The slit 17 is formed to extend in the vertical direction at the end portion on the side of the printer 12. The idle roller 16 is disposed adjacent to the slit 17. The winding mechanism 20 is disposed below an end opposite to the printer 12. The operation/display unit 22 is disposed above the winding mechanism 20. In short, as shown FIG. 2, the slit 17 is disposed on an upstream side in the direction of the arrow I in the roll paper winding device 13. The winding mechanism is disposed on a downstream side in the direction of the arrow I in the roll paper winding device 13. The idle roller 16 is disposed between the slit 17 and the winding mechanism 20. The tension roller 18 is disposed on the upstream side of a winding core 51 in a conveyance direction of the continuous paper P. The idle roller 16 is disposed between the winding core 51 and the tension roller 18 in the conveyance direction of the continuous paper P and guides the continuous paper P in the conveyance direction of the continuous paper P.

Further, the winding mechanism 20 includes the winding shaft 35, a first circular plate portion 40, a second circular plate portion (not shown), a tightening claw 53, and a tightening knob 54. The winding shaft 35 protrudes from the front panel 15 and is rotatably disposed, and is connected to the rotation transmitting system 39. The first circular plate portion 40 is formed so as to protrude radially outward at the base portion of the winding shaft 35 on the side of the front panel 15. The second circular plate portion protrudes radially outward at the distal end portion of the winding shaft 35 and is detachably disposed with respect to the winding shaft 35. The tightening claw 53 is a tightening member that is arranged to be movable in the radial direction at a plurality of positions on the outer peripheral surface of the winding shaft 35. The tightening knob 54 is an operating portion that is rotatably disposed at the tip of the winding shaft 35 and moves the tightening claw 53 in the radial direction.

On the outer periphery of the winding shaft 35, the winding core 51 as a winding member, which has a cylindrical shape and serves as a core for winding the continuous paper P, is detachably disposed with respect to the winding shaft 35. In addition, the first circular plate portion 40 and the second circular plate portion prevent meandering of the continuous paper P wound on the winding core 51 in the width direction as the winding shaft 35 rotates. The paper roll is formed by winding the continuous paper P around the winding core 51.

The operation/display unit 22 includes an operation unit 41 for an operator to operate the roll paper winding device 13 and a display unit 42 for displaying the state of the roll paper winding device 13 or the like. On the operation unit 41, a power switch bt1, an activation switch bt2, an end switch bt3, or the like are arranged. The power switch bt1 is a switch for turning on/off the power supply of the roll paper winding device 13. The activation switch bt2 is a switch for starting winding of the continuous paper P. The end switch bt3 is a switch for terminating the winding of the continuous paper P. On the display unit 42, an alarm lamp Lp, a display Ds, or the like as alarm devices are disposed.

As shown in FIG. 5, the rotation transmission system 39 includes a gear g1, a shaft sh1, a gear g2, a torque limiter 43, a gear g3, a gear g4, a slit disk 45, an encoder 46, or the like. The gear g1 is attached to an output shaft 47 of the winding motor 38 and outputs the rotation of the winding motor 38. The shaft sh1 rotatably supports the winding shaft 35. The gear g2 is attached to the shaft sh1 and transmits the rotation of the winding motor 38 to the winding shaft 35. The torque limiter 43 limits the torque transmitted from the winding motor 38 and transmits it to the winding shaft 35. The gear g3 engages with the gear g1 and is connected to the torque limiter 43. The gear g4 engages with the gear g2 and is connected to the torque limiter 43. The slit disk 45 is attached to the shaft sh1. The encoder 46 is disposed to face the slit disk 45.

The slit disk 45 and the encoder 46 form a speed sensor 48 as a speed detecting unit for detecting the rotation speed of the winding shaft 35. Further, an output of the speed sensor 48 varies according to the rotation of the winding shaft 35. Therefore, the speed sensor 48 is also referred to as an output sensor as an output changing unit whose output changes by the rotation of the winding shaft 35.

If the winding motor 38 is driven, the rotation output to the output shaft 47 is transmitted to the torque limiter 43 via the gears g1 and g3, and the rotation output from the torque limiter 43 is transmitted to the shaft sh1 via the gears g4 and g2, and the winding shaft 35 is rotated.

The rotation of the winding shaft 35 is blocked for some reason and when an excessive load is applied to the winding motor 38, the torque limiter 43 idles and transmission of torque from the side of the gear g3 to the side of the gear g4 is interrupted.

The limit torque LT of the torque limiter 43 is set so that the torque limiter 43 does not idle during normal winding operation. That is, when the paper roll having the maximum diameter on the specification of the roll paper winding device 13 is formed, assuming that the torque required to rotate the winding core 51 is Tr, the limit torque LT becomes LT>Tr. Therefore, when a load equal to or greater than the limit torque LT is applied to the continuous paper P, the torque limiter 43 idles.

The operator removes the second circular plate portion from the winding shaft 35, and attaches the winding core 51 to the winding shaft 35. The second circular plate portion is attached to the winding shaft 35 and the continuous paper P discharged from the discharge port 14 of the printer 12 is hung on the tension roller 18. The continuous paper P is passed between the idle roller 16 and the roller 19, and the leading end thereof is fixed to a predetermined position of the winding core 51. When the winding shaft 35 rotates, the continuous paper P is conveyed.

If the winding shaft 35 is rotated and the winding core 51 slides with respect to the winding shaft 35, winding failure of the continuous web P sometimes occurs. Therefore, after the winding core 51 is attached to the winding shaft 35, when the operator rotates the tightening knob 54 in the direction of the arrow D in FIG. 4, the tightening claw 53 moves in the radial direction (the direction of the arrow E), and the winding core 51 is tightened with respect to the winding shaft 35. Therefore, slippage does not occur between the winding shaft 35 and the winding core 51 as the winding shaft 35 rotates.

When winding of the continuous paper P by the roll paper winding device 13 is completed and the paper roll is formed, the operator removes the second circular plate portion from the winding shaft 35, and is rotated the tightening knob 54 in the direction opposite to the direction of arrow D. Then, the tightening claw 53 moves in the direction opposite to the direction of the arrow E, and the paper roll can be removed from the winding shaft 35.

The position of the tension roller 18 is changed according to the tension of the continuous paper P between the pair of discharge rollers 12*a* and the idle roller 16. That is, since the tension roller 18 contacts the continuous paper P by its own weight, and applies tension to the continuous paper P, if the tension of the continuous paper P is larger than the its own weight of the tension roller 18, the tension roller 18 moves upward. On the other hand, if the tension of the continuous paper P is smaller than its own weight of the tension roller 18, the tension roller 18 moves downward. Tension will not occur unless the tension roller 18 is in contact with the continuous paper P. A point A (also referred to as a lower position), a point B (also referred to as an intermediate position), and a point C (also referred to as an upper position) are set at three positions along the slit 17. Sensors Sa to Sc (FIG. 1) as first to third position detecting units to be described later are respectively disposed at points A to C, and the tension roller 18 (FIG. 1) which moves along the slit 17 is detected by each sensor Sa to Sc. That is, when the tension roller 18 moves to the point A, the sensor Sa detects the tension roller 18 and turns on, and when the tension roller 18 moves to the point B, the sensor Sb detects the tension roller 18 and turns on, and when the tension roller 18 moves to the point C, the sensor Sc detects the tension roller 18 and turns on. Detection of the position of the tension roller 18 is used to determine the timing of starting and stopping the winding shaft 35. Thereby, the continuous paper P is conveyed or stopped in a state in which a certain tension is applied from the tension roller 18. By winding in a state in which the continuous paper P is tensioned, the winding efficiency of the continuous paper P is secured.

The point C is set to a position where the tension roller 18 moves when the continuous paper P linearly extends between the discharge port 14 of the printer 12 and the idle roller 16.

Next, a control device of the roll paper winding device 13 will be described.

Figure 1:
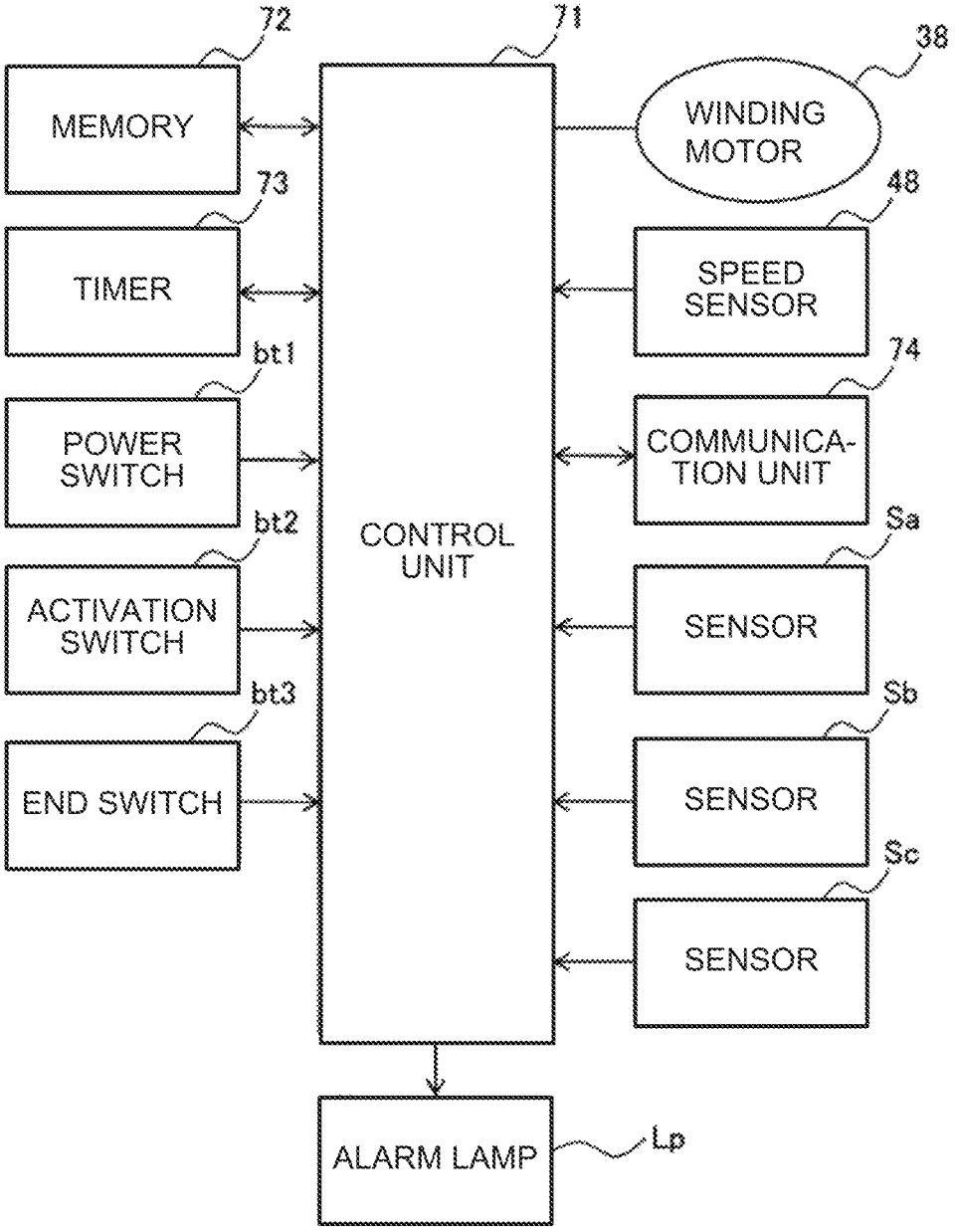
FIG. 1 is a control block diagram of a roll paper winding device in a first embodiment.

FIG. 1 is a control block diagram of a roll paper winding device in a first embodiment.

In the FIG, a control unit 71 controls the entire roll paper winding device 13 (FIG. 2). A memory 72 is a storage device. A timer 73 is a timing unit that measures time. A communication unit 74 communicates with the printer 12 via a wired or wireless network. "38" is a winding motor. "48" is a speed sensor. Sa to Sc are sensors. The control unit 71 determines whether or not slippage occurs between the winding shaft 35 and the winding core 51 based on the position of the tension roller 18 and the rotation speed of the winding shaft 35. Further, since the output of the speed sensor 48 (the output sensor) varies according to the rotation of the winding shaft 35, the control unit 71 may determine whether or not slippage occurs between the winding shaft 35 and the winding core 51 based on the position of the tension roller 18 and the output change result of the output sensor.

Also, "bt1" is the power switch. "bt2" is the activation switch. "bt3" is the end switch. "Lp" is the alarm lamp.

In the present embodiment, the roll paper winding device 13 can set a normal mode and the slip determination mode. In the normal mode, printing is performed in the printer 12, and the continuous paper P is wound up when the continuous paper P is discharged from the discharge port 14. In the slip determination mode, it is determined whether or not slippage occurs between the winding shaft 35 and the winding core 51 when printing is not performed in the printer 12.

When the normal mode is set to the roll paper winding device 13, the control unit 71 drives the winding motor 38 when the tension roller 18 is placed at the point A and the sensor Sa is turned on. When the tension roller 18 is placed at the point B and the sensor Sb is turned on, the control unit 71 stops the winding motor 38.

Therefore, when the sensor Sb is turned on while the continuous paper P is being discharged from the printer 12, the winding motor 38 and the winding shaft 35 are stopped, and the tension roller 18 moves downward. On the other hand, when the tension roller 18 reaches the point A and the sensor Sa is turned on, the winding motor 38 is driven and the winding shaft 35 rotates. Then, the continuous paper P is wound up, and the tension roller 18 moves upward. When the tension roller 18 reaches the point B and the sensor Sb is turned on, the winding motor 38 stops and the tension roller 18 again moves downward. That is, the tension roller 18 moves upward or downward as the winding motor 38 is driven or stopped.

Therefore, when the normal mode is set, the continuous paper P is discharged from the printer 12, and the winding shaft 35 rotates or stops during that time. Further, the tension roller 18 reciprocates between the point A and the point B, and the continuous paper P is intermittently wound around the winding core 51.

In the roll paper winding device 13, winding failure of the continuous paper P on the winding core 51 may occur due to various factors. Therefore, in the present embodiment, before the printer 12 starts printing, the operator sets the slip determination mode in the roll paper winding device 13. As a result, it can be determined whether or not slippage will occur between the winding shaft 35 and the winding core 51, and it can be predicted that winding failure will occur.

Next, the operation of the roll paper winding device 13 when the slip determination mode is set will be described.

Figure 6:
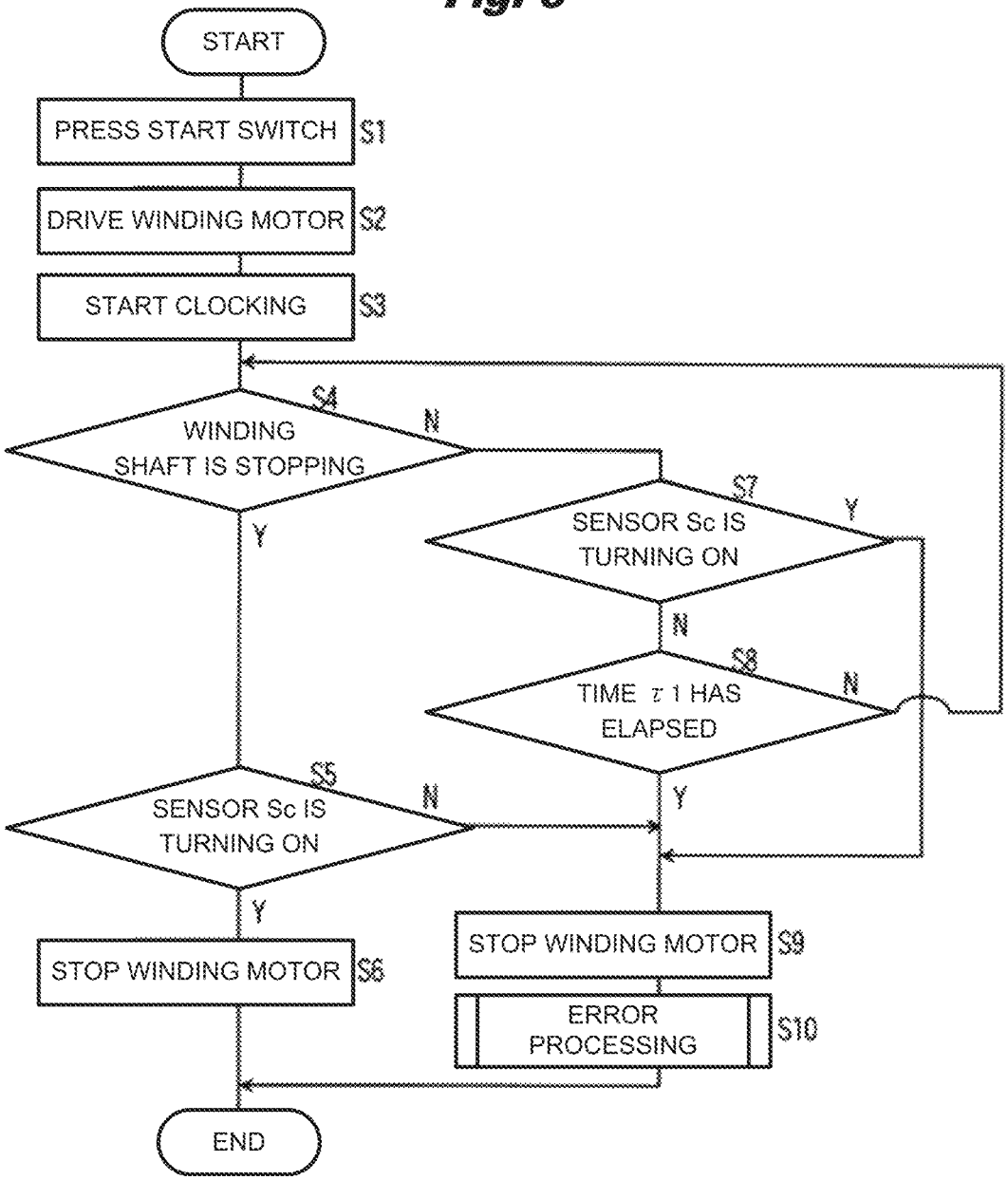
FIG. 6 is a flowchart illustrating an operation of the roll paper winding device in the first embodiment.
Figure 7:
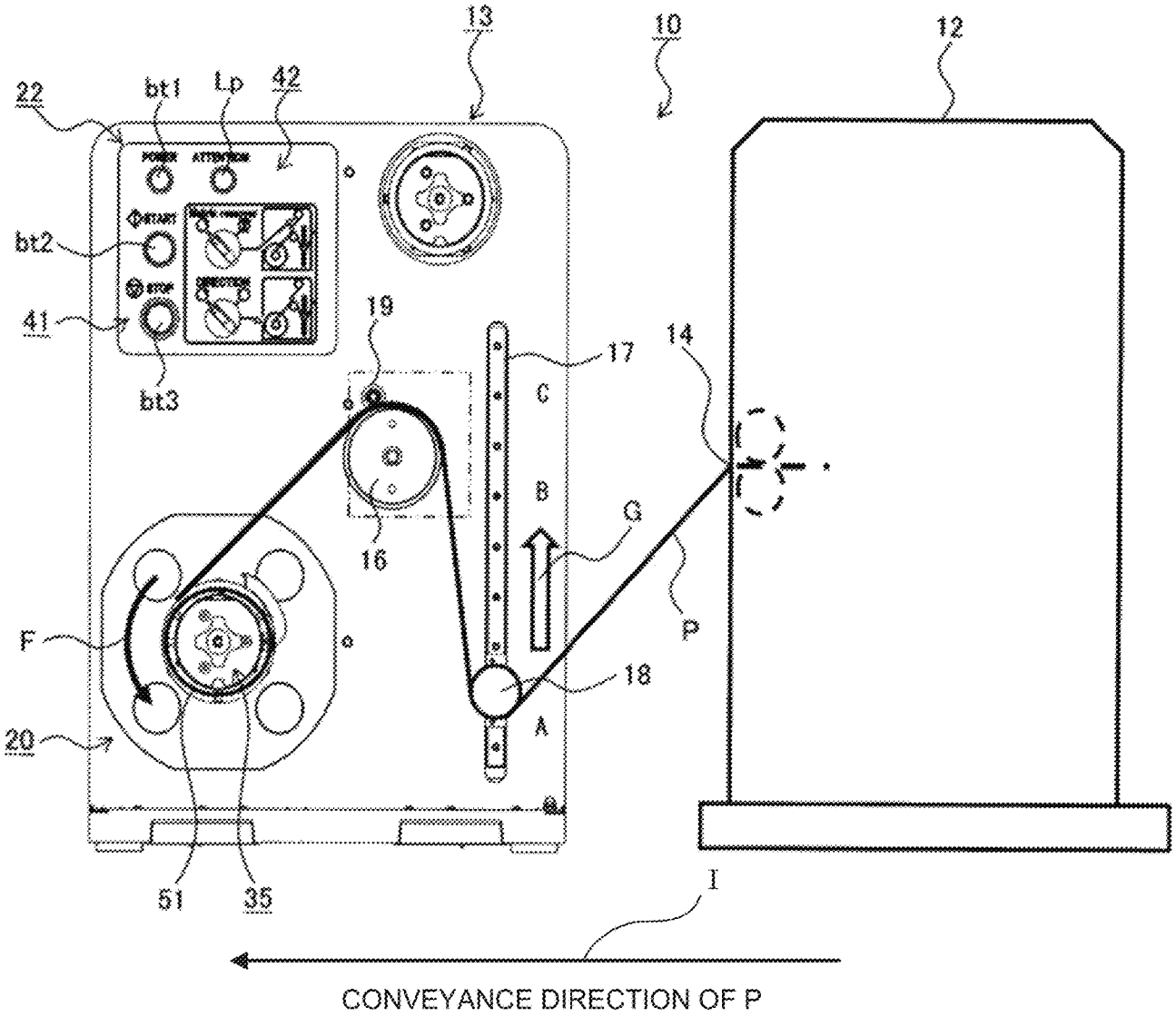
FIG. 7 is a first diagram for explaining the operation of the roll paper winding device in the first embodiment.
Figure 8:
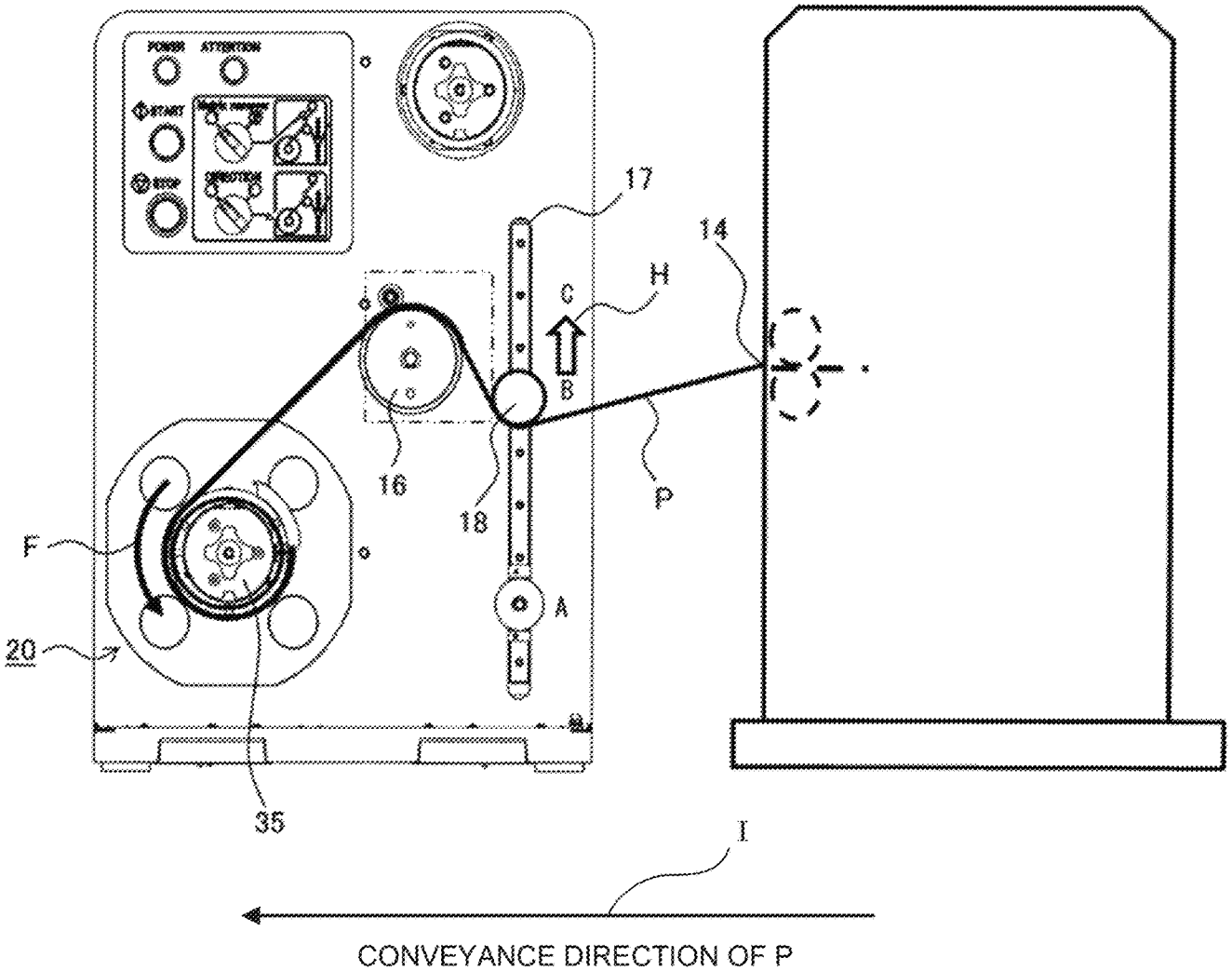
FIG. 8 is a second diagram for explaining the operation of the roll paper winding device in the first embodiment.
Figure 9:
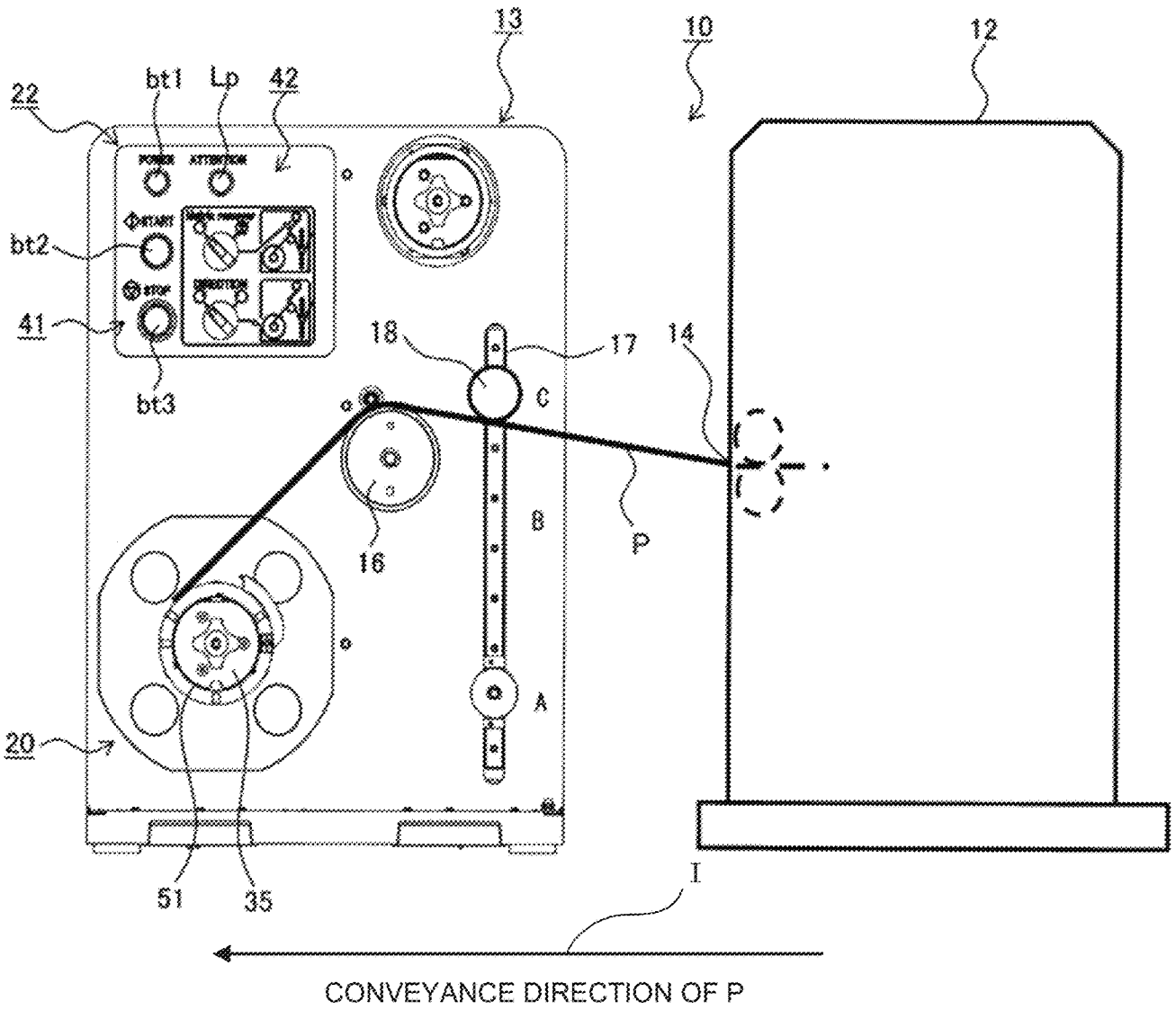
FIG. 9 is a third diagram for explaining the operation of the roll paper winding device in the first embodiment.

FIG. 6 is a flowchart illustrating an operation of the roll paper winding device in the first embodiment. FIG. 7 is a first diagram for explaining the operation of the roll paper winding device in the first embodiment. FIG. 8 is a second diagram for explaining the operation of the roll paper winding device in the first embodiment. FIG. 9 is a third diagram for explaining the operation of the roll paper winding device in the first embodiment.

When the slip determination mode is set, the printer 12 does not perform printing and the continuous paper P is not conveyed. In this case, the operator hangs on the tension roller 18 the continuous paper P taken out from the discharge port 14 of the printer 12. The continuous paper P is passed between the idle roller 16 and the roller 19 and the leading end of the continuous paper P is fixed to a predetermined position of the winding core 51 so as to set the continuous paper P in the roll paper winding device 13. At this time, the position of the tension roller 18 changes according to the length of the continuous paper P taken out from the discharge port 14 of the printer 12 and is placed at a predetermined position between the point A and the point C.

First, the operator presses the power switch bt1 to turn on the power supply of the roll paper winding device 13 (S1 in FIG. 6). Subsequently, when the activation switch bt2 is pressed, the control unit 71 drives the winding motor 38 to start winding operation of the continuous paper P by the roll paper winding device 13 (S2 in FIG. 6). That is, winding of the continuous paper P onto the winding core 51 is started.

At this time, the control unit 71 turns on the timer 73 and starts clocking (S3 in FIG. 6).

In the slip determination mode, since the continuous paper P is not discharged from the printer 12, when winding of the continuous paper P onto the winding core 51 is started, the tension roller 18 moves upward. For example, as shown in FIG. 7, when the winding operation of the continuous paper P by the roll paper winding device 13 is started, if the tension roller 18 is positioned at the point A, the tension roller 18 moves toward the point B in the direction of the arrow G. As shown in FIG. 8, when the winding operation of the continuous paper P by the roll paper winding device 13 is started, if the tension roller 18 is positioned at the point B, the tension roller 18 moves to the point C in the arrow H direction. That is, the tension roller 18 moves in the vertical direction along the slit 17 while being in contact with the continuous paper P.

Next, the control unit 71 reads the rotation speed of the winding shaft 35 detected by the speed sensor 48. Thereby, the control unit 71 determines whether or not the winding shaft 35 is stopped (S4 of FIG. 6). Further, the output of the speed sensor 48 (the output sensor) changes in accordance with the rotation of the winding shaft 35. Therefore, the control unit 71 may determine whether or not the winding shaft 35 is stopped based on the output change result of the output sensor.

When the winding shaft 35 is stopped, the control unit 71 determines whether or not the sensor Sc is turned on (S5 in FIG. 6). When the sensor Sc is turned on, as shown in FIG. 9, the continuous paper P extends linearly between the discharge port 14 of the printer 12 and the idle roller 16. At this time, despite the winding motor 38 being driven, since the winding shaft 35 is stopped, a tension larger than the limit torque LT is applied to the continuous paper P, and the torque limiter 43 idles.

In this case, the winding shaft 35 is not rotating, and slippage does not occur between the winding shaft 35 and the winding core 51. Therefore, even if the roll paper winding device 13 is set to the normal mode and the continuous paper P is wound around the winding core 51, there is no slippage between the winding shaft 35 and the winding core 51.

Accordingly, the control unit 71 stops the winding motor 38 (S6 in FIG. 6), and ends the processing in the slip determination mode.

If the winding shaft 35 is stopped and the sensor Sc does not turn on, before the tension roller 18 reaches the point C, the tension roller 18 is stopped. At this time, since the winding shaft 35 is not rotating, although the slippage does not occur between the winding shaft 35 and the winding core 51, the tension roller 18 has not reached the point C. In this case, it is considered that some abnormality occurred and the rotation of the winding shaft 35 was stopped.

Accordingly, the control unit 71 stops the winding motor 38 (S9 in FIG. 6) and performs error processing (S10 in FIG. 6). Then, the alarm lamp Lp is turned on to notify the operator that an abnormality has occurred.

Further, if the winding shaft 35 is not stopped, the control unit 71 determines whether or not the sensor Sc turns on (S7 in FIG. 6). If the sensor Sc turns on, the continuous paper P extends linearly between the discharge port 14 of the printer 12 and the idle roller 16. At this time, a tension larger than the limit torque LT is not applied to the continuous paper P. Further, since the winding shaft 35 is rotating, it can be seen that slippage occurs between the winding shaft 35 and the winding core 51.

In this case, if the roll paper winding device 13 is set to the normal mode and the continuous paper P is wound around the winding core 51, slippage does not occur between the winding shaft 35 and the winding core 51 at the initial stage of winding. However, as the diameter of the paper roll formed with the winding of the continuous paper P increases, there is a possibility that slippage may occur between the winding shaft 35 and the winding core 51, so that it can be predicted that winding failure occurs in the roll paper winding device 13.

Accordingly, the control unit 71 stops the winding motor 38 (S9 in FIG. 6) and performs error processing (S10 in FIG. 6). Then, the alarm lamp Lp is turned on, and the operator is notified that the roll paper winding device 13 is predicted to cause winding failure.

If the winding shaft 35 is not stopped and the sensor Sc does not turn on, it is assumed that the tension roller 18 is moving toward the point C as the continuous paper P is wound up.

Therefore, the control unit 71 determines whether or not a predetermined time T1 has elapsed since the clocking by the timer 73 has started (S8 in FIG. 6). Assuming that the time required for the tension roller 18 to move from the point A to the point C is $\tau 0$ in the roll paper winding device 13 when the winding failure is not occurring, the time $\tau 1$ is set to be longer than the time $\tau 0$. For example, $\tau 1=1.5\times\tau 0$.

Then, until the time $\tau 1$ elapses, the control unit 71 determines whether or not the winding shaft 35 is stopped (S4 in FIG. 6). When the winding shaft 35 stops until the time $\tau 1$ elapses, a tension larger than the limit torque LT is applied to the continuous paper P, and the torque limiter 43 idles.

In this case, there is no slippage between the winding shaft 35 and the winding core 51. Therefore, even if the roll paper winding device 13 is set to the normal mode and the continuous paper P is wound around the winding core 51, slippage does not occur between the winding shaft 35 and the winding core 51.

Therefore, the control unit 71 stops the winding motor 38 (S6 in FIG. 6), and terminates the process in the slip determination mode.

On the other hand, if the winding shaft 35 continues to rotate even after a lapse of the time $\tau 1$ since the clocking is started by the timer 73, there is a slippage between the winding shaft 35 and the winding core 51. Therefore, the tension roller 18 does not reach the point C.

In this case, if the roll paper winding device 13 is set to the normal mode and the continuous paper P is wound around the winding core 51, slippage can occur between the winding shaft 35 and the winding core 51 in the initial stage of winding. Therefore, it is predicted that winding failure will occur in the roll paper winding device 13.

Therefore, the control unit 71 stops the winding motor 38 (S9 in FIG. 6) and performs error processing (S10 in FIG. 6). Then, the alarm lamp Lp is turned on, and the operator is notified that the roll paper winding device 13 is expected to cause winding failure.

As described above, in the present embodiment, the control unit 71 determines whether slippage occurs between the winding shaft 35 and the winding core 51 based on the position of the tension roller 18 and the rotation speed of the winding shaft 35. Therefore, when there is a possibility of slippage between the winding shaft 35 and the winding core 51 in the initial stage of winding immediately after setting the winding core 51 on the winding shaft 35, it can be predicted that winding failure occurs in the roll paper winding device 13. In addition, when there is a possibility of slippage between the winding shaft 35 and the winding core 51 when the diameter of the paper roll formed with the winding of the continuous paper P increases, it can be predicted that winding failure occurs in the roll paper winding device 13.

Meanwhile, while the continuous paper P discharged from the printer 12 is being wound by the roll paper winding device 13, a gap is formed between the continuous paper P of the paper roll, and looseness may occur in the paper roll. In addition, even when printing is performed for a plurality of print jobs in the printer 12, even when printing of a predetermined print job is ended, looseness may occur in the paper roll.

Therefore, in the above case, a second embodiment which can eliminate looseness occurred in paper roll will be described. The same reference numerals are given to components having the same structure as those of the first embodiment, and the effects of the same embodiment are applied to the effect of the invention having the same structure.

Figure 10:
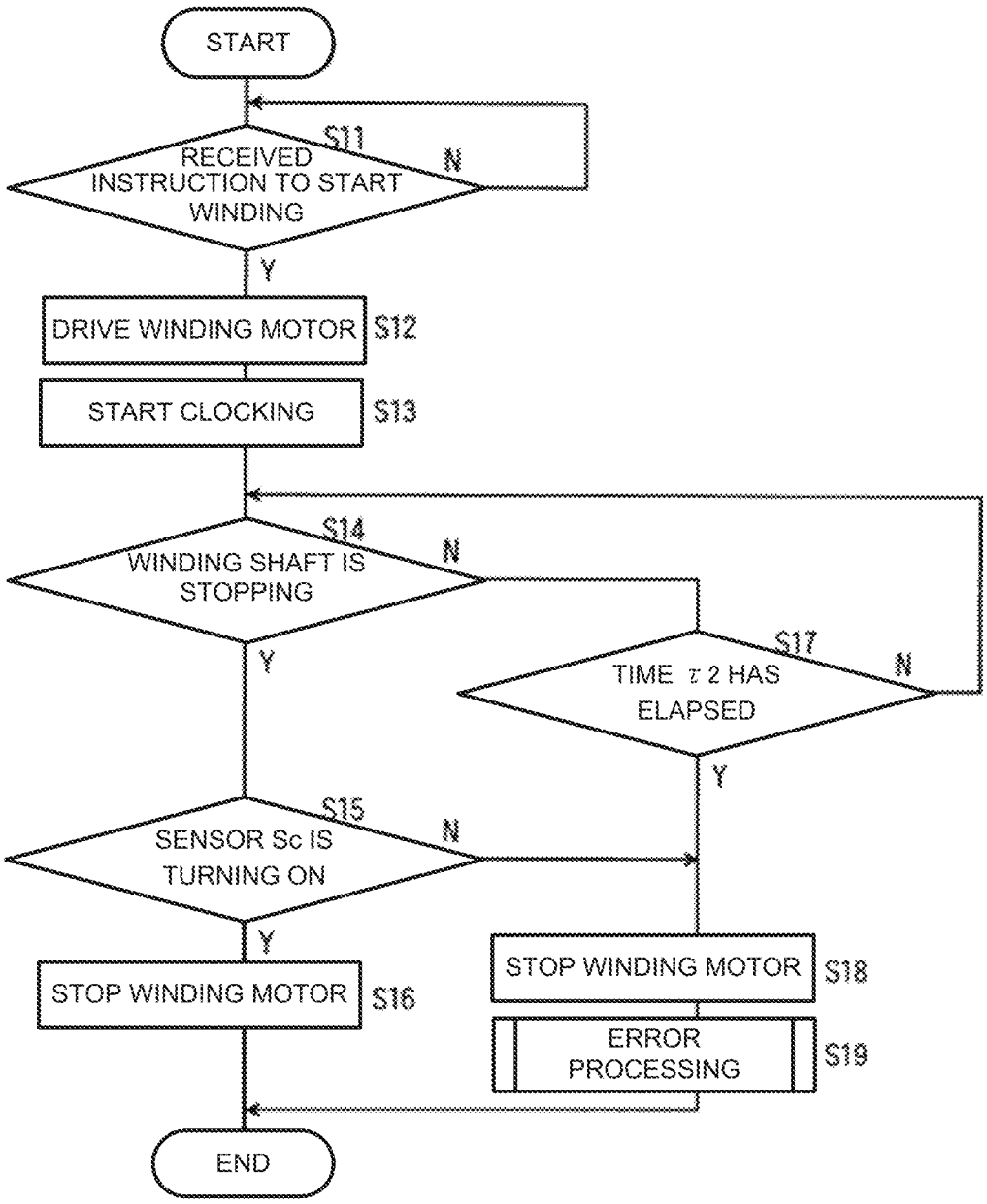
FIG. 10 is a flowchart illustrating the operation of the roll paper winding device in a second embodiment.
Figure 11:
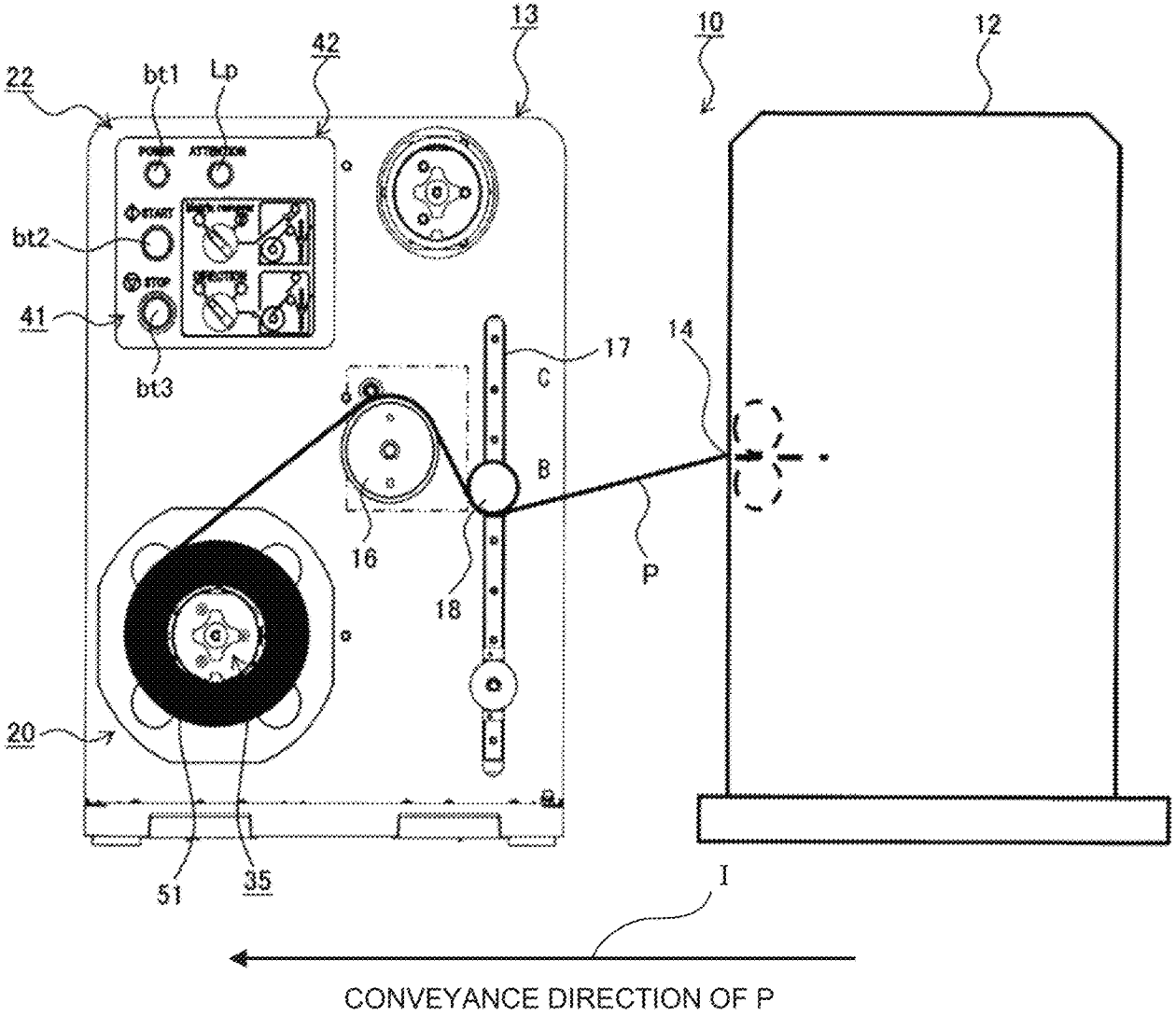
FIG. 11 is a first diagram for explaining the operation of the roll paper winding device in the second embodiment.
Figure 12:
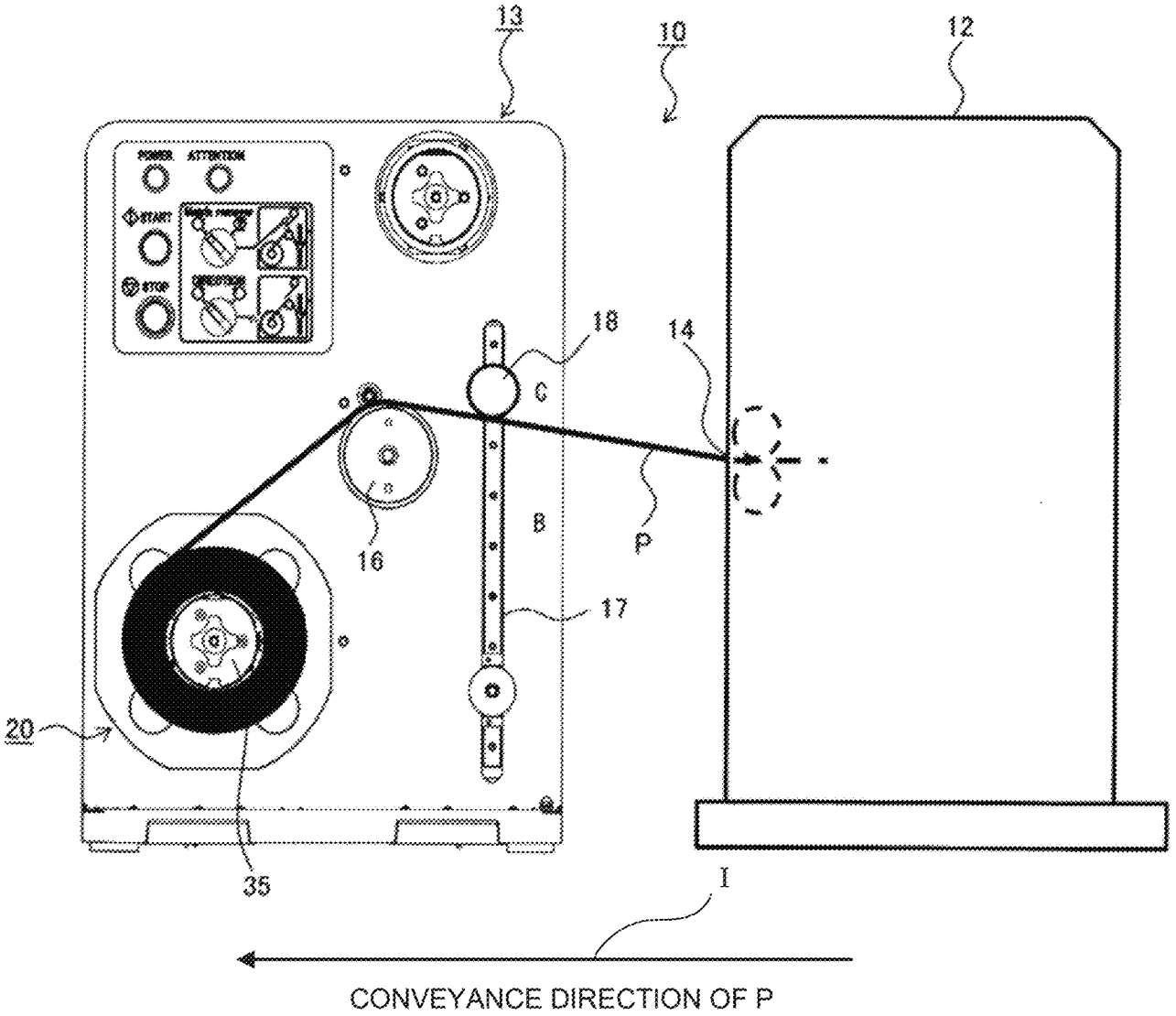
FIG. 12 is a second diagram for explaining the operation of the roll paper winding device in the second embodiment.

FIG. 10 is a flowchart illustrating the operation of the roll paper winding device in the second embodiment. FIG. 11 is a first diagram for explaining the operation of the roll paper winding device in the second embodiment. FIG. 12 is a second diagram for explaining the operation of the roll paper winding device in the second embodiment.

Before printing of the print job is started in the printer 12, the printer 12 sends an instruction to start the winding to the roll paper winding device 13. Upon receiving the instruction to start winding in the roll paper winding device 13 (S11 in FIG. 10), the control unit 71 drives the winding motor 38 in a state in which the continuous paper P is not discharged from the discharge port 14, and starts winding up the continuous paper P (S12 in FIG. 10).

In addition, the control unit 71 starts clocking with a timer 73 as a timer (S13 in FIG. 10).

In this case, the printing of the predetermined print job has been completed, and the continuous paper P is not discharged from the printer 12. Accordingly, winding of the continuous paper P onto the winding core 51 is started, and the tension roller 18 moves upward.

When the notification that the printing is completed is sent from the printer 12, the control unit 71 stops the winding motor 38 when the tension roller 18 reaches the point B, as shown in FIG. 11.

Therefore, when the winding shaft 35 rotates as the winding of the continuous paper P to the winding core 51 is started, the tension roller 18 moves upward (in the direction of the arrow G) from the point B to the point C. That is, the tension roller 18 moves in the vertical direction along the slit 17 while being in contact with the continuous paper P.

Next, the control unit 71 reads the rotational speed of the winding shaft 35 detected by the speed sensor 48, thereby determining whether or not the winding shaft 35 is stopped (S 14 in FIG. 10). Further, the output of the speed sensor 48 (output sensor) varies according to the rotation of the winding shaft 35. Therefore, the control unit 71 may determine whether or not the winding shaft 35 is stopped based on the output change result of the output sensor.

When the winding shaft 35 is stopped, the control unit 71 determines whether or not the sensor Sc as the third position detecting unit turns on (S15 in FIG. 10). When the sensor Sc turns on, as shown in FIG. 12, the continuous paper P extends linearly between the discharge port 14 of the printer 12 and the idle roller 16. In this case, the winding motor 38 is driven and the torque limiter 43 idles.

In this case, even if a tension larger than the limit torque LT is applied to the continuous paper P, the winding shaft 35 is not rotating. Since there is no slippage between the winding shaft 35 and the winding core 51, looseness generated in the paper roll is eliminated. Accordingly, the control unit 71 stops the winding motor 38 (S16 in FIG. 10) and instructs the printer 12 to start printing.

In the case where the winding shaft 35 is stopped and the sensor Sc does not turn on, before the tension roller 18 reaches the point C, the tension roller 18 is stopped. At this time, since the winding shaft 35 is not rotating, although the slippage does not occur between the winding shaft 35 and the winding core 51, the tension roller 18 has not reached the point C. In this case, it is considered that some abnormality occurred and the rotation of the winding shaft 35 was stopped.

Accordingly, the control unit 71 stops the winding motor 38 (S18 in FIG. 10) and performs error processing (S19 in FIG. 10). Then, the alarm lamp Lp is turned on to notify the operator that an abnormality has occurred.

Further, when the winding shaft 35 is not stopped, it is assumed that the tension roller 18 is moving toward the point C as the continuous paper P is wound.

Therefore, the control unit 71 determines whether or not the time $\tau 2$ has elapsed since clocking by the timer 73 was started (S17 of FIG. 10). The time required for the tension roller 18 to move from the point B to the point C by winding up the continuous paper P on the winding core 51 in the case where the roll paper is not loosened is $\tau a$. The time required to eliminate the looseness caused in the roll paper is $\tau b$. At this time, the time $\tau 2$ is set to be longer than the sum of the time $\tau a$ and the time $\tau b$. For example, $\tau 2 = 1.5 \times (\tau a + \tau b)$.

Then, the control unit 71 determines whether or not the winding shaft 35 is stopped until the time $\tau 2$ has elapsed since clocking by the timer 73 was started. When the winding shaft 35 stops until the time $\tau 2$ elapses, a tension larger than the limit torque LT is applied to the continuous paper P, and the torque limiter 43 idles.

In this case, since the looseness occurring in the paper roll has been eliminated, the control unit 71 stops the winding motor 38 and instructs the printer 12 to start printing for the next print job.

On the other hand, if the winding shaft 35 is not stopped even after the elapse of the time $\tau 2$, the continuous sheet P is in a state of being linearly extended between the discharge port 14 of the printer 12 and the idle roller 16. Therefore, since the winding motor 38 is being driven and the torque limiter 43 is idling, it can be seen that some trouble has occurred.

Accordingly, the control unit 71 stops the winding motor 38 (S18 in FIG. 10) and performs error processing (S19 in FIG. 10). Then, the alarm lamp Lp is turned on to notify the operator that an abnormality has occurred.

In this manner, in the present embodiment, the control unit 71 eliminates looseness occurring in the paper roll based on the position of the tension roller 18 and the rotation speed of the winding shaft 35. Even if the paper roll is loosened when the printing is stopped and resumed as in the case of printing for a plurality of print jobs, the looseness is eliminated before the printing for the next print job is started. Therefore, winding quality of the paper roll can be stabilized.

In each of the above embodiments, the printer 12 is described, but the present invention can be applied to an image forming apparatus such as a copying machine, a facsimile, a multifunction machine, or a medium processing apparatus.

Further, each of the above embodiments may be combined.

It should be noted that the present invention is not limited to each of the above described embodiments, and various modifications can be made based on the gist, and these are not excluded from the scope of the present disclosure.

The invention claimed is:

1. A medium winding device, comprising:

a winding member that winds a medium in a roll and is detachably disposed with respect to a winding shaft;

a drive unit that gives a rotation drive force to the winding shaft, and that includes a winding motor, which generates the rotation drive force, and a drive transmission unit including a torque limiter that idles when torque equal to or greater than a limit torque is applied to the winding shaft from the winding motor;

a tension applying member that is disposed so as to be movable along a guide on the upstream side of the winding member in a conveyance direction of the medium, moves from a first position to a second position along the guide while being in contact with the medium to be conveyed, and provides tension to the medium to be conveyed wherein tension stretching the medium at the second position is greater than the tension at the first position;

a position detecting unit that detects a position of the tension applying member;

a rotation detecting unit that detects a rotation of the winding shaft; and a control unit that notifies an operator that an abnormality has occurred when the position detecting unit detects that the tension applying member is at the second position (Sc ON) and the rotation detecting unit detects that the winding shaft to which the rotation drive force of the winding motor is transmitted by the torque limiter is rotating.

2. The medium winding device according to claim 1, wherein when a roll medium having a maximum diameter is formed on the winding member, the limit torque is set to be larger than torque required for rotating the winding member.

3. The medium winding device according to claim 1, wherein the tension applying member reciprocates between the first position and the second position, and the tension applying member further takes a third position, which is between the first position and the second position on the guide as the drive unit is driven or stopped.

4. The medium winding device according to claim 3, wherein the rotation detecting unit is a speed detecting unit that detects a rotation speed of the winding shaft.

5. The medium winding device according to claim 4, wherein;

the control unit reads the rotation speed of the winding shaft detected by the speed detecting unit, determines a state as to whether or not the winding shaft is stopped, the control unit reads the position of the tension applying member detected by the position detecting unit, determines a state as to whether or not the tension applying member is moved to the second position above the third position wherein the guide extends in a vertical direction, the first position is a lower position lower than the third position, the second position is an upper position than the third position and the third position is an intermediate position, which is between the lower position and the upper position, the control unit determines whether slippage occurs between the winding shaft and the winding member, the slippage causing the winding member to idle over the winding shaft, based on a state of the winding shaft and a state of the tension applying member.

6. The medium winding device according to claim 5, wherein the medium winding device is configured to wind the medium that exits from a discharge port of a printer, the medium winding device further includes an idle roller that is disposed between the guide and the winding member on a conveying path of the medium wherein the idle roller is in contact with the medium regardless of the position of the tension applying member and the idle roller is driven by the medium being conveyed in the conveying direction, the upper position is defined as a position of the tension applying member such that the medium extends linearly between the discharge port of the printer and the idle roller.

7. The medium winding device according to claim 6, wherein the control unit determines that there is no slippage between the winding shaft and the winding member when the winding shaft is stopped and the tension applying member is moved to the upper position.

8. The medium winding device according to claim 6, wherein the control unit determines that slippage occurs between the winding shaft and the winding member when the winding shaft is rotating and the tension applying member is moved to the upper position.

9. The medium winding device according to claim 6, wherein the control unit determines that slippage occurs between the winding shaft and the winding member when the winding shaft is rotating and the tension applying member is not moved to the upper position until the predetermined time elapses.

10. The medium winding device according to claim 5, wherein the guide is arranged aligning parallel to the gravity direction, which is perpendicular to the ground.

11. The medium winding device according to claim 1, wherein the rotation detecting unit is a speed sensor, and the speed sensor detects the rotation speed of the winding shaft.

12. The medium winding device according to claim 1, further comprising a rotating member that is disposed between the winding member and the tension applying member in the conveyance direction of the medium, guides the medium in the conveyance direction of the medium.

13. The medium winding device according to claim 1, further comprising a timer that measures time, wherein when the control unit determines that a predetermined time has elapsed since a clocking by the timer, the control unit notifies an operator that an abnormality has occurred.

14. The medium winding device according to claim 1, wherein the control unit does not notify the operator of the abnormality when the position detecting unit detects that the tension applying member is at the second position and the rotation detecting unit detects that the winding shaft is not rotating.

15. A printing system comprising a printer and a medium winding device for winding up a medium discharged from a discharge port of the printer, wherein the medium winding device comprises:

a winding member which winds the medium in a roll is detachably disposed with respect to a winding shaft;

a drive unit that gives a rotation drive to the winding shaft, and that includes a winding motor and a drive transmission unit including a torque limiter that idles when torque equal to or greater than a limit torque is applied;

a tension applying member that is disposed so as to be movable along a guide on the upstream side of the winding member in a conveyance direction of the medium, moves from a first position to a second position along the guide while being in contact with the medium to be conveyed, provides tension to the medium to be conveyed;

a position detecting unit that detects a position of the tension applying member;

a rotation detecting unit that detects a rotation of the winding shaft; and a control unit that notifies an operator that an abnormality has occurred when the position detecting unit detects that the tension applying member is at the second position and the rotation detecting unit detects that the winding shaft to which a rotation drive force of the winding motor is transmitted by the torque limiter is rotating.

16. A medium winding device, comprising:

a winding member which winds the medium in a roll is detachably disposed with respect to a winding shaft;

a winding motor;

a drive transmission unit that is connected with the winding shaft and gives a rotation drive force from the winding motor to the winding shaft; and a tension applying member that is disposed so as to be movable along a guide on the upstream side of the winding member in a conveyance direction of the medium, moves from a first position to a second position along the guide while being in contact with the medium to be conveyed, and provides tension to the medium to be conveyed, wherein the drive transmission unit includes a torque limiter that limits the rotation drive force from the winding motor, and the winding shaft does not rotate when the torque limiter idles.

* * * * *